United States Patent [19]

Eckerle et al.

[11] Patent Number: 4,472,123

[45] Date of Patent: Sep. 18, 1984

[54] INTERNAL GEAR MACHINE WITH SEGMENTED FILLER MEMBERS

[75] Inventors: Otto Eckerle; Klaus Buchmüller, both of Malsch, Fed. Rep. of Germany

[73] Assignee: Messrs. Otto Eckerle GMBH & Co. KG, Malsch, Fed. Rep. of Germany

[21] Appl. No.: 199,090

[22] Filed: Oct. 20, 1980

[30] Foreign Application Priority Data

Oct. 19, 1979 [DE] Fed. Rep. of Germany ..... 2942417

[51] Int. Cl.[3] ..... F03C 2/08; F04C 2/10; F04C 15/00

[52] U.S. Cl. ..... 418/126; 418/129; 418/169

[58] Field of Search ..... 418/126, 129, 169, 170

[56] References Cited

U.S. PATENT DOCUMENTS

| | | | |
|---|---|---|---|
| 3,291,060 | 12/1966 | Bottoms | 418/170 |
| 3,486,459 | 12/1969 | Eltze | 418/126 |
| 4,132,514 | 1/1979 | Eckerle | 418/126 |

*Primary Examiner*—John J. Vrablik
*Attorney, Agent, or Firm*—Louis E. Marn

[57] ABSTRACT

In an internal gear pump comprising a ring gear and a pinion in mesh therewith to define a lunate cavity therebetween, a segmented part-lunate filler inserted in said cavity has supporting faces contacting a pin which extends axially through the cavity and is rotatable about its longitudinal axis. In operation, the resulting forces acting on the filler segments are transmitted to the pin by said supporting faces and produce a torque about the longitudinal pin axis.

14 Claims, 10 Drawing Figures

FIG. I
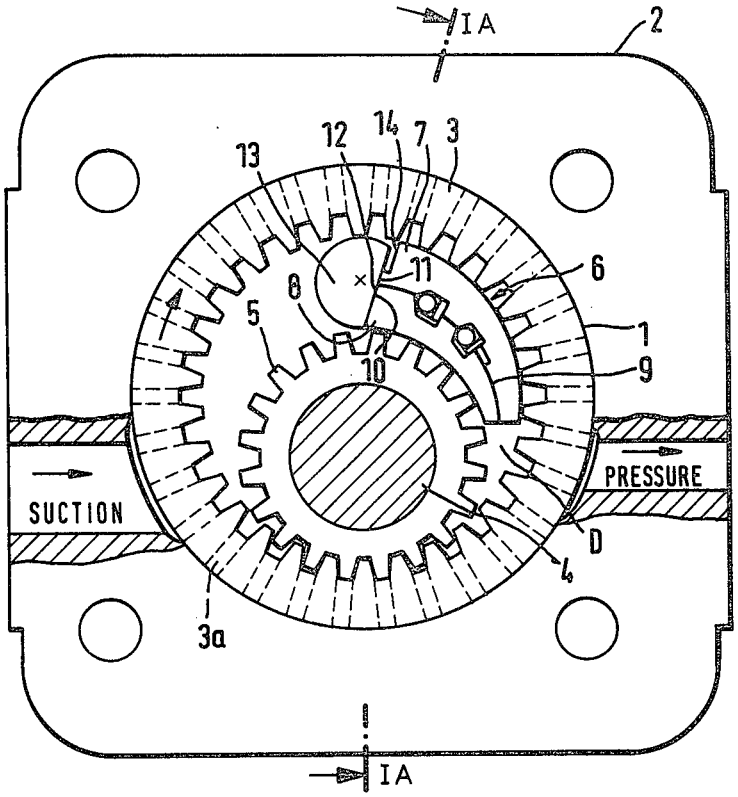
FIG. IA
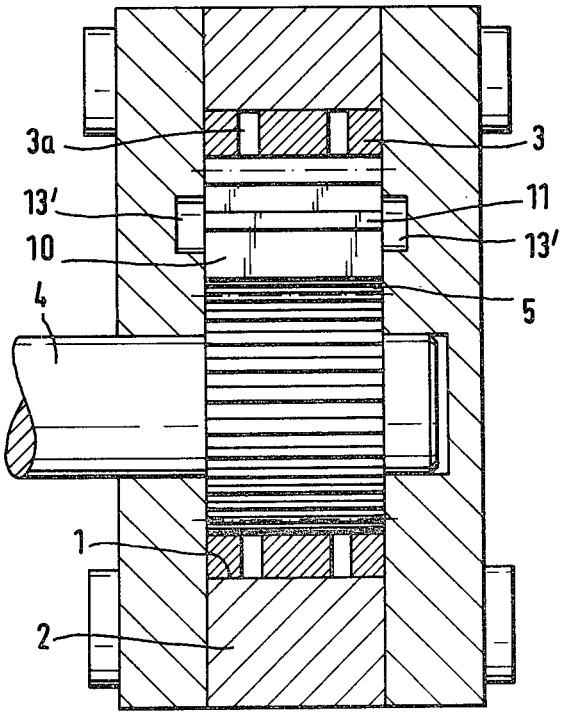

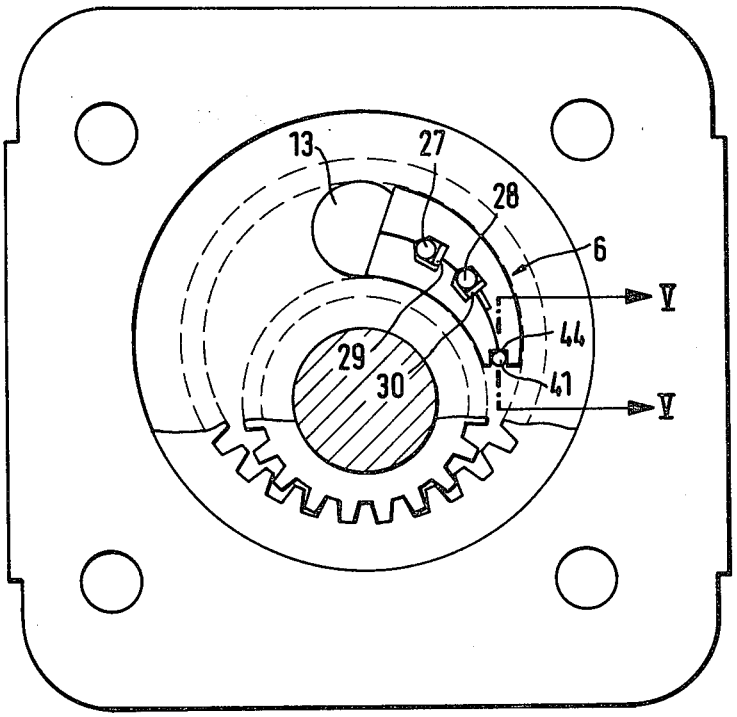
FIG.4
FIG.5
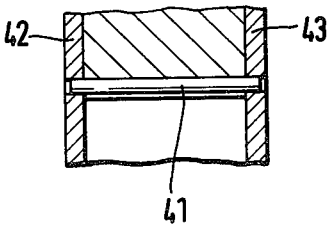

INTERNAL GEAR MACHINE WITH SEGMENTED FILLER MEMBERS

The invention relates to an internal gear machine, particularly an internal gear pump, comprising a ring gear with internal teeth, a pinion with external teeth in mesh therewith, and a semilunate filler member which is segmented along a substantially circumferentially extending parting face and of which the filler segments have supporting faces for support on a filler pin passing axially through the space between the ring gear and pinion.

An internal gear pump of the aforementioned kind is known (DE-OS No. 25 33 646). In this known gear machine, the filler member is formed by two filler segments which can be imaged as a halving division of an entire filler member. By means of this division, one ensures that, by reason of the pressure obtaining between the filler segments, the filler segments can be separately applied to the tooth crests of the associated gears and in this way the radial changes in the disposition of the parts of the machine that are to be sealed from each other can be compensated independently from each other. By means of their supporting faces adjacent the filler pin, the filler segments are supported on a planar flat of the filler pin and transmit thereto the resulting fluid forces which tend to push the filler segments out of contact with the pinion and ring gear against the direction of rotation of the gears.

It has been found from experience that the sealing effect of a segmented filler member of the kind here in question is still inadequate at the crests of the teeth despite the individual mobility of the filler segments. The invention is therefore based on the problem of achieving an optimum sealing effect of the segmented filler member in an internal gear machine of the aforementioned kind.

According to the invention, this problem is solved in that the filler pin is rotatable in known manner about its longitudinal axis and that the resulting forces which act on the filler segments and are transmitted to the filler pin by the supporting faces produce a torque about the longitudinal axis of the filler pin.

The invention is based on the realization that the forces which are exerted on the filler segments and push their supporting faces onto the flat of the filler pin hold the filler segments on the flat in a certain manner so that, although there is individual displaceability of the filler segments parallel to the flat of the filler pin, the desired pivotability is prevented. Now, to avoid this hindrance on the filler segments resulting in an incomplete seal, the filler pin is mounted to rotate about its longitudinal axis, as has hitherto been known in the case of filler members made in one piece, so that the filler segments may execute a pivotal motion about the longitudinal axis of the filler pin in addition to their individual displaceability. However, rotation of the filler pin for the purpose of the radial compensation is achieved only if, in accordance with the present invention, the filler segments are appropriately dimensioned and formed to ensure that the forces exerted on the filler segments do indeed produce a torque on the filler pin. This is achieved either in that the resulting pressure forces transmitted by the supporting faces of the two filler segments are of unequal magnitude and act thereon with substantially equally long lever arms in relation to the longitudinal axis of the filler pin, or in that equal resulting forces act on unequally long lever arms.

For reasons of stiffness of the filler segments which are pressed against the tooth crests under the influence of the operating pressure, it is desirable to divide the filler member substantially in half in the circumferential direction so that the parting face extends approximately centrally. It has been found that the resultants of the pressure forces transmitted by the supporting faces of the two filler segments are in this case not only of equal magnitude but, by reason of the same size of supporting faces, also engage the filler pin with equally long lever arms. Since this produces equilibrium on the filler pin, its rotation and thus pivoting of the filler member is suppressed despite the rotatable mounting of the filler pin. According to an advantageous embodiment of the invention, therefore, it is provided that in such a case the end face adjacent the filler pin for at least one filler segment forms a limited supporting face by being locally set back or stepped and the set back or stepped end face extends up to the circumferential edge of the filler segment. In this way constructional provision ensures that the resultants of the pressure forces engage unequally long lever arms by way of the unequally large supporting faces of the two filler segments so that the desired torque is produced.

According to a particularly advantageous development of the invention, it is provided that the set back or stepped end face is provided on the filler segment contacting the ring gear and extends up to the circumferential surface of the filler segment adjacent the ring gear. The same result can be achieved if the set back or stepped end face is provided on the filler segment contacting the pinion but in that case this end face extends up to the circumferential surface of the filler segment adjacent the pinion. This ensures that the torque produced by the two resultant forces and transmitted to the filler pin by the supporting faces of the filler segments pivots the filler member in one direction by reason of rotation of the filler pin whereas, by reason of arranging the supporting face near the parting face in the case of the filler segment having the set back or stepped end face, this filler segment has a tendency to tilt or pivot in the opposite direction. Accordingly, the described construction and arrangement can alone ensure that the filler segments are spread apart and this, in conjunction with the displaceability of the filler segments along the flat of the filler pin, results in an optimum abutment and sealing against the tooth crests of the ring gear and pinion.

An alternative solution for the underlying problem of moving the two filler segments in the direction of the tooth crests of the abutting gears for the purpose of efficient sealing resides in the feature that opposed recesses in the filler segments extending from the parting face each have an inclined face parallel to the axis and together define at least one parting face chamber in which the inclined faces are disposed in wedge formation to each other, and that a sealing roller movable in the parting face chamber is sealingly pressed against the inclined faces under the fluid pressure and pushes the filler segments apart. This solution may be employed independently or in conjunction with the previously described construction.

The inclined faces which partially bound the parting face chamber in wedge formation are preferably disposed parallel to the longitudinal axis of the filler pin so that the wedge effect exerted by the sealing roller on the inclined faces results in uniform loading of the filler segments in the direction of the gear crests. Advantageously, there are two parting face chambers each having a sealing roller so as to obtain some distribution in the longitudinal direction of the wedge effect exerted by the sealing rollers. Desirably, the apex of the wedge formation subtended between the inclined faces is directed towards the filler pin so that particularly the thicker regions of the filler segments are pressed apart by the wedging effect and can be displaced along the flat of the filler pin.

The sealing roller is desirably biassed towards the inclined faces by a leaf spring. This is intended to ensure that, even on starting the gear machine, i.e. at a time when the operating pressure is still close to zero, the filler segments will already be applied to the tooth crests to achieve an immediate sealing effect.

The effective spreading force on the parting face of the filler segments is not only that produced by the sealing roller under the wedge effect but is also obtained from the interaction of all the fluid forces acting on the filler segments. These forces are, however, influenced by the more or less high accuracy of the geometric shape of the filler segments and the tooth crest circle, whereby the amount of leakage from the pressure chamber is determined. In addition, the viscosity of the liquid plays a part and, finally, the rotational speed is also significant because this determines the gradient of the pressure rise within the prefilling zones. Depending on the size of these influencing factors, they could result in unequilibrium between the spreading force acting on the filler segments and the counteracting forces. Now, in order to avoid the filler segments from becoming lifted off the tooth crests or being pressed thereagainst with excessive forces, a further embodiment of the invention provides that the parting face chamber is connected to the prefilling zone adjacent the pinion and adjacent the ring gear. This connection, which may for example be brought about by a passage through the filler segments but is desirably obtained by a groove in the region of the axial plates, ensures that there will be a pressure balance between the prefilling zones and the parting face chamber. If, for example by reason of wear or manufacturing errors, liquid can escape from a prefilling zone, e.g. at the ring gear, towards the suction side and the pressure in this prefilling zone is therefore reduced, this pressure reduction will likewise occur in the parting face chamber that is responsible for the spreading force as well as in the prefilling zone of the other gear, e.g. at the pinion. This ensures the desired equilibrium of forces.

By reason of the fact that the filler segments will abut the tooth crests even when the gear machine is at a standstill because sealing rollers are provided in the parting face chamber, there is a certain tendency for the filler segments to cling to the tooth crests. In addition, after a prolonged standstill of the gear machine the filler segments may also stick to the tooth crests. This presents the danger of carrying the filler segments along in the direction of rotation and damaging same when the gear machine is started. According to a development of the invention, therefore, it is provided that the tip of the filler member is held against displacement of the filler member in the direction of rotation of the gears by a preferably resiliently prestressed pin having its ends mounted in the axial plates or in the housing. Desirably, the pin passes through a recess in the ends of the filler segments. The pin locates the filler member in the direction of rotation of the gears and it can therefore move in this direction to only a limited extent or not at all. Since the recess provided at the filler segments to receive the pin is likewise open towards the parting face, the desired mobility of the filler segments relatively to the filler pin is not impeded. If the pin is additionally prestressed, it will also ensure abutment of the filler member against the flat of the filler pin.

Particularly in the case of high pressure machines of the kind here in question, axial plates are arranged at the end faces of the gears and of the filler member for the purpose of axial compensation of the forces that occur. The filler member abuts these axial plates with the lateral end faces. These axial plates suppress the mobility of the filler segments by reason of the strong friction created by the abutting pressure. In order not to influence the mobility of the filler segments, the invention therefore also provides for the axial end faces of the filler segments to have a circumferential sealing rim with which they abut the axial plates or the associated housing walls, and for the chamber defined within the sealing rim to communicate with the pressure chamber. The sealing rim forms an enlargement of the circumferential faces and of the end faces of the filler segments adjacent the filler pin in the axial direction. The chamber bounded by the sealing rim is filled with liquid by communicating with the pressure chamber for example by way of a small aperture near the tip of the filler member. This considerably reduces the friction and yet enables an exact axial seal to be achieved. This feature of the invention can likewise be advantageously used in conjunction with the previously described constructional features but is also independently applicable.

Finally, the invention also relates to an internal gear machine in which, apart from the gear ring and pinion, there is also a lunate or semi-lunate filler member and the axial plates which abut endwise on the gears and filler member and bring about axial compensation. These axial plates are pressed endwise onto the gears and filler member by pressure zones subjected to the operating pressure. Hitherto, the pressure zones were produced by recesses in the housing walls adjoining the axial plates. However, the production of these pressure zones which have to be very accurately dimensioned is a comparatively expensive operation. If incorrectly formed, the entire housing portion is wasted. According to the invention, therefore, the pressure zones are formed in shells disposed between the housing wall and the axial plates. This enables the housing portions and the pressure zones to be produced in an uncomplicated manner. This is particularly so if, according to a further embodiment, the shells are formed without machining, e.g. by deep drawing.

Additional advantages and features of the present invention will become evident from the following description of examples with reference to the accompanying drawings, wherein:

FIG. 1 is a cross-section through an internal gear pump according to the invention;

FIG. 1A is a longitudinal section through the internal gear pump of FIG. 1 along the line I—I in FIG. 1;

FIG. 4 is a view similar to the preceding figures of an embodiment showing a pin limiting the mobility in the direction of rotation of the gears;

FIG. 5 is a section on the line V—V in FIG. 4 showing the position of the pin more clearly.

Figure 1B:
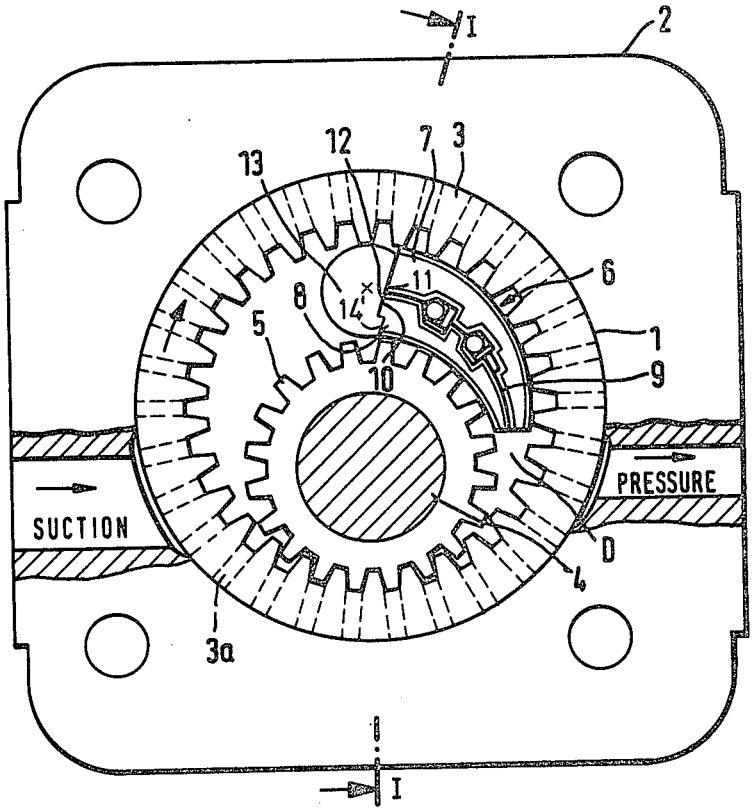
FIG. 1B is a longitudinal section through the internal gear pump of FIG. 1.

In the internal gear pump shown in FIG. 1, a gear ring 3 with internal teeth is slidingly mounted in a bore 1 of a housing 2. By means of a pinion shaft 4 which passes through and is mounted in axial bores of the housing 2, it is possible to drive a pinion 5 which is in mesh with the gear ring 3. The direction of rotation of the gears 3 and 5 is given by an arrow.

As will be evident from FIG. 1, the housing 2 has a suction port on the intake side and a pressure port on the output side within the housing 2, both these ports being in communication with the bore 1 of the housing 2. As will be evident from FIGS. 1 and 2, the gear ring 3 is provided over its entire circumference with uniformly distributed radial bores 3*a* through which the suction and pressure ports are in communication with the internal chamber bounded by the gear ring 3. By rotation of the gear ring 3 and pinion 5, the pressure medium such as oil is sucked through the suction port, passes through the radial bores 3*a* and is conveyed to a pressure chamber D by the tooth gaps formed between the teeth of the gear ring 3 and pinion 5. Thereafter, it again passes through the radial bores 3*a* and, from the pressure port, reaches a place of use. The construction as just described and the function of the internal gear pump are known and do not have to be explained further.

In the lunate chamber between the gates 3 and 5 there is a filler member generally indicated at 6 and composed of two filler segments 7, 8. The filler segment 7, 8 abut along a parting face 9 and have supporting faces 10, 11 for support against a flat 12 of a filler pin 13. The filler pin 13 passes axially through the lunate chamber in which the filler member 6 is disposed and, as shown in FIG. 1A, is mounted in bearing holes 13' of the lateral housing walls and/or in axial plates which may be provided at the ends of the gears 3 and 5, the pin being rotatable about its longitudinal axis.

As will be evident from FIG. 1, the filler segment 8 adjacent the pinion 5 is supported on the flat 12 by means of a supporting face 10 which extends over the entire width of the end face adjacent the filler pin. On the other hand, the filler segment 7 adjacent the gear ring 3 is provided with a step 14 in the end face adjacent the filler pin 13, this step extending towards the parting face 9 by about two thirds starting from the outer circumferential face of the filler segment 7. It follows that the supporting face 11 with which the filler segment 7 abuts the flat 12 is only about one third of the actual end face of the filler segment 7. Consequently, the filler segment 7 adjacent the gear ring has a tendency to tilt towards the tooth crests of the gear ring 3 and thereby abuts same. In addition, by reason of the corresponding dimensioning of the filler segments 7,8, the tooth geometry of the gears 3, 5 and the lunate chamber defined between the gears 3, 5, one ensures that the common resultant of the forces acting on the filler segments 7, 8 and pushing them onto the flat 12 by way of the supporting faces 10, 11 produces a torque about the longitudinal axis of the filler pin 13 indicated by an arrow in FIG. 1. This ensures that the filler pin 13 will execute rotation under the influence of this resultant, leading to pivoting of the filler member 6 in a direction towards the pinion 5. By reason of this pivoting, the filler segment 8 abuts the tooth crests of the pinion. Constructional provision is thereby made for the filler member 6 to have an adequate mobility in order to compensate the radial changes in the gap between the tooth crests and the filler member that occur during operation.

As will be evident from FIGS. 1 to 4, each filler segment 7, 8 comprises two recesses 20, 21 which extend from the parting face 9 are open towards the parting face 9 and together define two parting face chambers 22, 23. Those faces of the recesses 20, 21 which are parallel to the axis and adjacent the filler pin 13 are so inclined as shown in the drawing that they together produce wedge faces 24, 25 in the parting face chambers 22, 23. Each parting face chamber 22, 23 also contains a sealing roller 27, 28 (see FIG. 4) which passes through the filler member 6 and is biassed by a respective leaf spring 29, 30 towards the filler pin 13. The leaf springs 29, 30 can either be secured in the filler member 6 alone and be supported thereon or they could also extend beyond the axial end faces of the filler member 6 and be supported in any axial plates that are provided.

The sealing rollers 27, 28 make sealing line contact with the wedge faces 24, 25 and, in addition to the spring load caused by the leaf springs 29, 30, will during operation of the gear machine be subjected to the one-sided pressure of the liquid which arrives in the parting face chambers 22, 23 along the parting face 9. The sealing rollers 27, 28 thereby exert on the wedge faces 24, 25 and thus on the filler segments 7, 8 a spreading force which causes them to abut the crests of the teeth.

Figure 2:
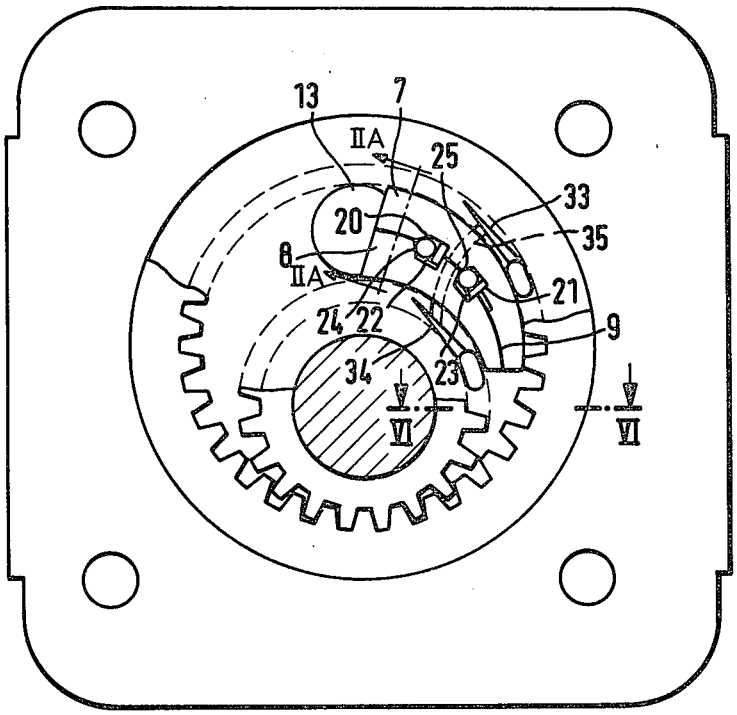
FIG. 2 is a cross-section similar to FIG. 1 showing the arrangement of connecting passages in the axial plates between the parting face chamber and the prefilling zones of the gears.
Figure 2A:
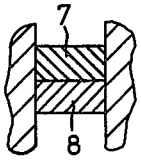
FIG. 2A is a cross-sectional view through the filler member along the line IIA—IIA of FIG. 2.

FIG. 2 also shows so called prefilling slots 33, 34 in the vicinity of the ends of the teeth of the gear ring 3 and pinion 5 and provided in axial plates (not shown). These prefilling slots 33, 34 define prefilling zones in which pressure adaptation can take place up to the pressure chamber. The prefilling slots 33, 34 are interconnected by a groove 35 likewise extending along the axial plates and are connected via parting face 9 to the parting face chambers 22, 23. There is therefore pressure equilibrium between these zones and chambers even on fluctuation of the pressure in only one of the chambers.

Figure 3A:
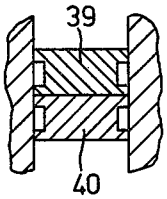
FIG. 3A is a cross-sectional view through the filler member along the line IIIA—IIIA of FIG. 3.
Figure 3:
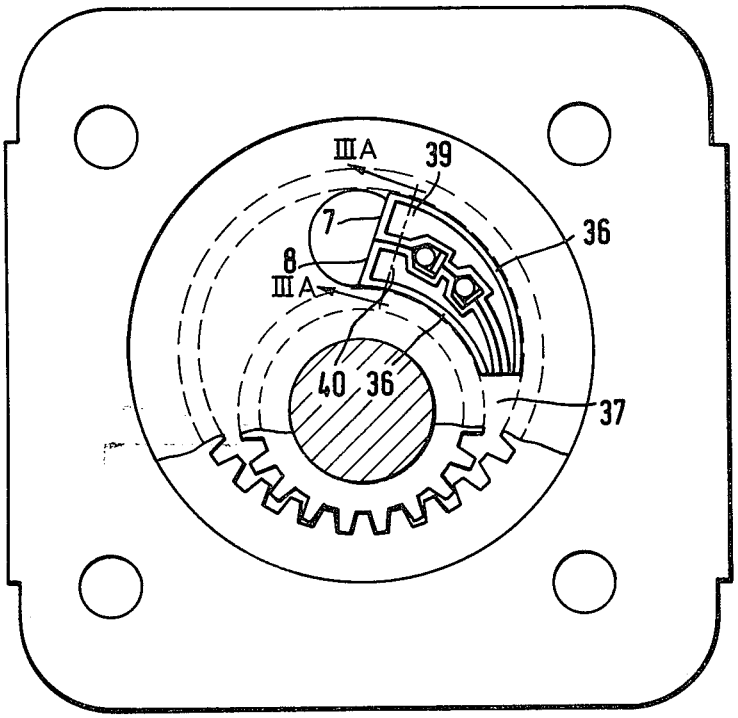
FIG. 3 is a view similar to FIGS. 1 and 2 showing the construction of the sealing rim at the axial end faces of the filler segments.

FIG. 3 shows an embodiment of the filler segments 7, 8 which produces particularly little friction between the axial end faces of the filler segments 7, 8 and the axial plates (not shown) against which they abut. The axial end faces of the filler segments 7, 8 are provided with circumferential sealing rims 36 which are slightly interrupted towards the pressure chamber 37 in the vicinity of the tip of the filler member. The sealing rims 36 correspond to the contour of the filler segments 7, 8 and therefore constitute an axial enlargement of these filler segments. Within the sealing rims 36 there are formed chambers 39, 40 which are subjected to liquid from the pressure chamber 37 and in the region of which between the axial plates and the filler segments 7, 8 there is only negligible fluid friction in relation to the necessary mobility of the filler member in the radial direction.

FIGS. 4 and 5 show a constructional feature by which the displaceability of the filler member 6 is limited in the direction of rotation of the gears. The provision in question is a spring steel pin 41 which is under prestress in bending and is fixed in the axial plates 42, 43 which lie against the ends of the gears 3, 5 and the filler member 6. The pin 41 passes through a recess 44 at the tip of the filler member, the recess being formed by two grooves of the filler segments 7, 8 that extend from the parting face 9. The pin 41 is so prestressed that it presses the filler member 6 onto the flat 12 of the filler pin 13. On starting of the machine, this prevents the filler member 6 from being taken along in the direction of rotation of the gears towards the pressure chamber 37, which could result in damage.

Figure 6:
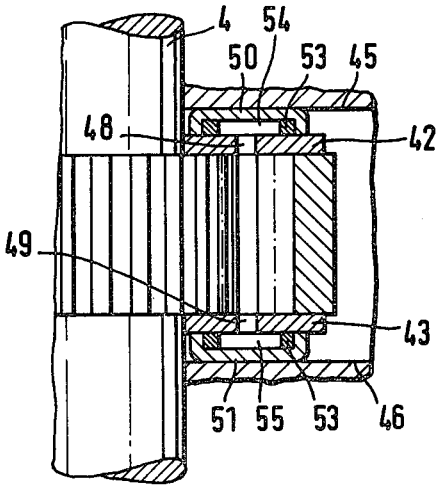
FIG. 6 is a section on the line VI—VI in FIG. 2 showing the construction of pressure zones in special shells beyond the axial plates.

FIG. 6 shows a partial longitudinal section of the axial plates 42, 43 provided at the ends for the purpose of axial compensation and also shows the outline of housing walls 45, 46 of the housing 2. Apertures 48, 49 in the axial plates 42, 43 lead to the pressure chamber 37. Deep-drawn shells 50, 51 of steel disposed between the housing walls 45, 46 and the exterior surfaces of the axial plates 42, 43 bound axial pressure zones 54, 55 together with inserted sealing rings 53. The shells 50, 51 are supported on the outside of the axial plates 42, 43 by means of the sealing rings 53.

We claim:

1. A hydraulic gear machine, which comprises:
a housing having a bore;
a ring gear including internal teeth disposed within said bore of said housing;
a pinion having external teeth disposed within said ring gear and defining a lunate-shaped chamber therebetween, said external teeth of said pinion cooperating with said internal teeth of said ring gear;
a semi-lunate filler member disposed in said lunate-shaped chamber and comprised of segmented elements having supporting faces and having cooperating substantially circumferential extending parting faces;
a filler pin axially disposed through said lunate-shaped chamber and rotatably journaled about a longitudinal axis, said filler pin having a supporting flat surface cooperating with said supporting faces of said segmented elements comprising said filler member.

2. An internal gear machine according to claim 1, characterized in that an end face of at lease one of said segmented elements adjacent said filler pin (13) forms a limited supporting face, said end face of said segmented element including a stepped portion extending up to a circumferential edge of said segmented element.

3. An internal gear machine according to claim 2, characterized in that said segmented element including said stepped portion contacting said ring gear (3) extends up to a circumferential surface of said segmented element adjacent said ring gear.

4. An internal gear machine according to claim 2, characterized in that said stepped end face of said segmented element contacts said pinion (5) and extends up to a circumferential surface of said segmented element adjacent said pinion.

5. An internal gear machine particularly accord-to one of claims 1, 2, 3 or 4, characterized in that opposed recesses (20, 21) in said segmented elements extending from said parting face have an inclined face parallel to the axis and together define at least one parting face chamber (22, 23) in which the inclined faces (24, 25) are disposed in wedge formation and that a sealing roller (27, 28) movable in said parting face chamber (22, 23) is sealingly pressed against said inclined faces (24, 25) under fluid pressure and push apart said segmented elements.

6. An internal gear machine according to claim 5, characterised in that there are two parting face chambers (22, 23) each having a sealing roller (27, 28).

7. An internal gear machine according to claim 5 characterised in that an apex of said wedge formation subtends between said inclined faces (24, 25) towards said filler pin (13).

8. An internal gear machine according to claim 5 characterized in that each of said sealing rollers (27, 28) is biassed towards said inclined faces (24, 25) by a leaf spring (29, 30).

9. An internal gear machine according to claim 5 characterized in that said parting face chamber (22, 23) is connected to a prefilling zone (33, 34) adjacent said piston and said ring gear.

10. An internal gear machine according to one of claims 1, 2, 3 or 4, characterised in that the tip of the filler member is held against displacement of the filler member (6) in the direction of rotation of the gears (3, 5) by a preferably resiliently prestressed pin (41) having its ends mounted in the axial plates (42, 43) or in the housing (2).

11. An internal gear machine according to claim 10, characterised in that the pin (41) passes through a recess (44) in the ends of the filler segments (7, 8).

12. An internal gear machine particularly according to one of claims 1, 2, 3 or 4, characterised in that the axial end faces of the filler segments (7, 8) have a circumferential sealing rim (36) with which they abut axial plates (42, 43) or the associated housing walls, and that the chamber (39, 40) defined within the sealing rim (36) communicates with the pressure chamber (37).

13. An internal gear machine, particularly an internal gear pump, comprising a ring gear with internal teeth, a pinion with external teeth in mesh therewith, a lunate or semi-lunate filler member, and axial plates which abut endwise on the gears and filler member, bring about axial compensation and are pressed endwise on the gears and filler member by pressure zones subjected to the operating pressure, particularly according to one of claims 1, 2, 3 or 4, characterised in that the pressure zones (54, 55) are formed in shells (50, 51) disposed between the housing wall (45, 46) and the axial plates (42, 43).

14. An internal gear machine according to claim 13, characterised in that the shells (50, 51) are formed without machining, e.g. by deep drawing.

* * * * *